US006621199B1

(12) United States Patent
Parfeniuk et al.

(10) Patent No.: US 6,621,199 B1
(45) Date of Patent: Sep. 16, 2003

(54) HIGH INTENSITY ELECTROMAGNETIC RADIATION APPARATUS AND METHOD

(75) Inventors: Dean Allister Parfeniuk, Anmore (CA); David Malcolm Camm, Vancouver (CA); Johan George Fourie, North Vancouver (CA); Roger Housden, Coquitlam (CA); Arne Kjørvel, Vancouver (CA); Steven McCoy, Coquitlam (CA); Sujay Prasad, Vancouver (CA); Tilman Jochen Thrum, Richmond (CA)

(73) Assignees: Vortek Industries Ltd., Vancouver (CA); Vortex Industries Ltd., Vancouver (CA)

( * ) Notice: Subject to any disclaimer, the term of this patent is extended or adjusted under 35 U.S.C. 154(b) by 0 days.

(21) Appl. No.: 09/492,917

(22) Filed: Jan. 21, 2000

(51) Int. Cl.[7] ..... H01J 17/26; H01J 17/28; H01J 61/52

(52) U.S. Cl. ..... 313/231.51; 313/24; 313/23; 313/231.41; 313/35; 250/504 R; 250/436; 250/493.1; 118/723 R

(58) Field of Search ..... 313/231.51, 12, 313/22, 23, 35, 231.31, 231.41, 231.61, 231.71; 250/504 R, 436–438, 493.1; 118/723 R, 723 MW, 723 MA; 315/101, 111.21, 111.71

(56) References Cited

U.S. PATENT DOCUMENTS

| | | | | |
|---|---|---|---|---|
| 3,292,028 A | | 12/1966 | Van Ornum | |
| 3,366,815 A | | 1/1968 | Anderson | |
| 3,463,957 A | * | 8/1969 | Fuksiewicz | 219/75 |
| 3,596,124 A | * | 7/1971 | Cleaver et al. | 313/146 |
| 3,603,827 A | | 9/1971 | Jiro Degawa et al. | |

FOREIGN PATENT DOCUMENTS

| | | | | |
|---|---|---|---|---|
| CA | 1015817 | | 8/1977 | |
| EP | 0 404 406 | | 12/1990 | |
| EP | 0 841 685 A2 | | 5/1998 | |
| JP | 57197742 | | 12/1982 | |
| JP | 07022194 A | * | 1/1995 | H05H/1/26 |

OTHER PUBLICATIONS

Atlas Electric Devices Company, "Specialists in Environmental and Material Testing", Bulletin 1650, Jul. 1992, pp. 1–8, Chicago, Illinois.

DSI Industrial Lighting Products web site, http://www.heatbuster.com/, Nov. 29, 1999, various pages including http://www.heatbuster.com/Prod_Cold_Mirror.htm, http://www.heatbuster.com/Prod_Hot_Mirror.htm, http://www.heatbuster.com/Prod_High_Temp_Cold.htm, http://www.heatbuster.com/Technical.html.

Electric Devices Company, "Xenon Arc Light Systems", Bulletin 1183, pp. 1–4, Chicago, Illinois.

(List continued on next page.)

*Primary Examiner*—Nimeshkumar D. Patel
*Assistant Examiner*—Sikha Roy
(74) *Attorney, Agent, or Firm*—Knobbe Martens Olson & Bear, LLP

(57) ABSTRACT

A method and apparatus for producing high intensity electromagnetic radiation are disclosed. The apparatus includes a high intensity arc lamp having an inner envelope cooled by a first flow of liquid along an inside surface of the inner envelope. The arc lamp includes first and second electrodes for generating a high power plasma arc within the inner envelope, the arc emitting the radiation. The apparatus further includes a cooling device for producing a second flow of liquid in contact with an outside surface of the inner envelope. In order to approximate a desired electromagnetic radiation spectrum, the apparatus may further include an energy redistributor for redistributing energy within a first radiation spectrum generated by the arc to produce a second radiation spectrum.

60 Claims, 4 Drawing Sheets

U.S. PATENT DOCUMENTS

| | | | | | |
|---|---|---|---|---|---|
| 3,612,933 | A | | 10/1971 | Troue | |
| 3,651,358 | A | | 3/1972 | Troue | 313/12 |
| 3,739,215 | A | * | 6/1973 | Murai | 313/24 |
| 3,816,784 | A | * | 6/1974 | Weninger | 313/22 |
| 4,027,185 | A | | 5/1977 | Nodwell et al. | 313/35 |
| 4,325,006 | A | * | 4/1982 | Morton | 313/22 |
| 4,700,102 | A | | 10/1987 | Camm et al. | 313/24 |
| 4,794,230 | A | * | 12/1988 | Seliskar et al. | 219/121.49 |
| 4,937,490 | A | | 6/1990 | Camm et al. | 313/12 |
| 4,945,288 | A | | 7/1990 | Morris et al. | 313/25 |
| 5,036,242 | A | | 7/1991 | Huber et al. | 313/35 |
| 5,147,130 | A | * | 9/1992 | Watanuki | 165/104.32 |
| 5,608,227 | A | | 3/1997 | Dierks et al. | |
| 5,756,959 | A | * | 5/1998 | Freeman et al. | 219/119 |
| 6,156,995 | A | * | 12/2000 | Severance, Jr. | 219/121.5 |

* cited by examiner 10
11
14
15
17
18
20
22
24
25
26
28
29
30
31
32
33
34
35
36
37
38
39
40
41
42
43
44
45
46
47
48
49
50
51
53
55
57
58
60
61
65
70,71
87
88
89
94
96
98
99
100
105
106
108
109
110
111
113
114
115
118
119
120
122
124
127
129
130
131
12
13
2

RELATIVE INTENSITY
WAVELENGTH
147 Original spectrum
148 Spectrum after first absorption filter
149 Spectrum after interference filter
151 Spectrum after second absorption filter
145 Desired spectrum
164
167
166
161
157
159
156
158
163
141
153
155
147
148
149
151
145
154
143

HIGH INTENSITY ELECTROMAGNETIC RADIATION APPARATUS AND METHOD

FIELD OF THE INVENTION

The present invention relates to electromagnetic radiation sources, and more particularly to a method and apparatus for producing high intensity electromagnetic radiation.

BACKGROUND OF THE INVENTION

Arc lamps are well known and have many industrial and scientific applications, ranging from simulation of sunlight to rapid thermal processing in the manufacture of semiconductor computer chips, for example. An arc lamp typically includes a cylindrical quartz tube filled with an inert gas such as xenon or argon, for example. A plasma arc is generated and sustained between a pair of electrodes spaced axially apart within the tube. Conventional arc lamps of this nature are widely available with power outputs of up to 10 to 20 kilowatts, for example, roughly two orders of magnitude more powerful than a conventional filament lamp.

More recently, improving upon such arc lamps, a new generation of high intensity arc lamps has been produced, such as the water wall arc lamps manufactured by Vortek Industries Ltd. of Vancouver, Canada. In such a water wall arc lamp, a high pressure water flow, typically seven atmospheres for example, is circulated in a vortex motion along an inner surface of the cylindrical arc tube, to cool the tube. The vortex motion of the water results in more efficient cooling of the tube and also minimizes or eliminates splashing which might otherwise interfere with the arc. It has been found that water wall arc lamps of this nature are capable of achieving much higher power outputs than arc lamps which lack such an outer wall. For example, typical water wall arc lamps manufactured by Vortek Industries Ltd. range from 200 kilowatt to 500 kilowatt output and custom arc lamps having power outputs of 1.5 megawatts or greater are also available.

However, high intensity arc lamps of this nature pose special problems that do not significantly affect other, less powerful arc lamps. Many applications require electromagnetic radiation with a specific spectral distribution that differs from the emission spectrum of an arc lamp. For example, designing and testing of solar energy cells require simulated sunlight, which typically requires a general reshaping of the arc lamp's emission spectrum as well as a reduction in the relative intensity of strong lines in the arc lamp spectrum. Typical low power arc lamps provide optical filters to filter undesirable wavelengths from the arc radiation spectrum to obtain a filtered spectrum which more closely approximates sunlight. One sunlight simulation system supplied by Atlas Electric Devices Company of Chicago, U.S.A., uses xenon as an inert gas because this gas generates an arc that is similar to sunlight. Undesirable wavelengths are filtered from the arc spectrum by use of transparent selective absorption materials such as glass, quartz or borosilicate glass, for example. However, absorption of undesirable wavelengths also heats the material.

For relatively low power applications involving 10 to 20 kilowatt arc lamps, for example, use of absorption filters is appropriate as the relatively small amount of heat generated by this absorption can be removed at a reasonable cost. However, absorption filtering is not practical for existing water wall arc lamps or other high intensity arc lamps, as the absorbing materials become significantly overheated. A removal of such additional heat is difficult or impractical to achieve, and the useful lifetime of the absorption filtering materials is greatly reduced due to the increased thermal stress to which they are subjected. In addition, absorption filtering arc lamps require an initial "aging" process during which time the lamp cannot be used for accurate work because the radiation characteristics vary greatly. Although the radiation characteristics eventually stabilize to some extent, they nevertheless continue to vary and thus, even substituting "pre-aged" absorption filtering lamps detracts from usefulness of the lamp.

As an alternative to absorption filtering, reflective coatings have been applied to relatively low power arc lamps, to act as partial reflection optical filters. Such filters serve to pass desirable wavelengths through the filter, and reflect undesirable wavelengths back into the arc chamber, thus reducing heat build-up and waste of energy by absorption filtering. Partially reflecting filters of this nature may include "semi-silvered", vapor-deposited metallic film filters, or interference filters formed by special compounds deposited on the transparent material of the arc tube or on separate filter glasses. However, such reflective coatings are not suitable for existing water wall arc lamps or other high intensity arc lamps. Any type of reflection filtering is imperfect and some radiation is always absorbed by the filters, and also by the glass or quartz through which the radiation passes. For example, when a reflective coating is applied to an outer surface of an arc tube of an existing 500 kilowatt water wall arc lamp, the reflective coating would quickly begin to burn off due to the large amount of heat resulting from partial absorption of the arc lamp radiation. Such overheating and burning of the reflective coating would interfere with its filtering characteristics and would result in an extremely short useful lifetime. In addition, the increased heat would significantly increase the thermal stress on the arc tube itself, thereby significantly reducing the useful lifetime of the tube.

More generally, even in the absence of absorption or reflection filtering, arc tubes in high intensity arc lamps such as the aforementioned water wall arc lamps are generally subjected to much higher thermal and pressure stresses than corresponding tubes on relatively low power arc lamps.

Accordingly, there is a need for a way to obtain a desired high intensity output spectrum from a high intensity arc lamp.

SUMMARY OF THE INVENTION

The present invention addresses the above need by providing methods and apparatus for producing high intensity electromagnetic radiation. One such method involves generating a high power plasma arc between first and second electrodes of a high intensity arc lamp having an inner envelope and having a first flow of liquid along an inside surface of the inner envelope, the arc emitting the radiation. The method further involves producing a second flow of liquid in contact with an outside surface of the inner envelope. This preferably involves directing the second flow of liquid through a cooling chamber defined between the outside surface of the inner envelope and an inside surface of an outer envelope surrounding the inner envelope. Thus, both the inside and outside surfaces of the inner envelope are exposed to respective flows of liquid, thereby improving cooling of the inner envelope. This reduces the thermal stress on the inner envelope, thereby increasing its useful lifetime. In addition, this improved cooling allows for reflective coatings such as interference filters or other partially reflecting optical filters to be applied to the outside surface of the inner envelope without quickly burning off or otherwise deteriorating. Consequently, the invention allows reflective coatings to be used on high intensity arc lamps to enable a desired, high intensity spectrum to be produced.

The first flow of liquid on the inside surface of the inner envelope may be operated at a first pressure and the second flow of liquid on the outside surface of the inner envelope may be operated at a second pressure selected to achieve a desired balance between a first pressure gradient across the inner envelope and a second pressure gradient across the outer envelope. Because the arc chamber is typically pressurized at a relatively high pressure, such as seven atmospheres for example, this allows for the pressure load on the inner envelope to be significantly reduced.

According to another aspect of the invention, there is provided an apparatus for producing high intensity electromagnetic radiation. The apparatus includes a high intensity arc lamp having an inner envelope cooled by a first flow of liquid along an inside surface of the inner envelope and having first and second electrodes for generating a high power plasma arc within the inner envelope, the arc emitting the radiation. The apparatus further includes a cooling device for producing a second flow of liquid in contact with an outside surface of the inner envelope. The apparatus may further include an outer envelope surrounding the inner envelope to define a cooling chamber in a space between the outside surface of the inner envelope and an inside surface of the outer envelope.

Preferably, the apparatus further includes an energy redistributor for redistributing energy within a first radiation spectrum generated by the arc to produce a second radiation spectrum. The energy redistributor may include a partially reflecting optical filter for reflecting a first portion of energy at a first waveband centered about a strong line of the first radiation spectrum back into the arc, such that at least some of the first portion of energy is re-emitted at a second wavelength outside the first waveband. This effect, which was not previously feasible with high intensity arc lamps due to the overheating and burning of such filters, has been found to be particularly advantageous in such high power arc lamps. A significant amount of energy at undesirable wavelengths may thus be absorbed by the plasma arc and re-emitted in one of two ways. Some such absorbed energy is thermalized by the arc, or in other words, the temperature of the arc increases, thereby increasing the intensity across the entire spectrum of radiation emitted by the arc. Other portions of such absorbed energy are shifted from strong lines onto weak lines of the arc's emission spectrum. Thus, energy at undesirable wavelengths may be effectively shifted to both desirable wavelengths and to somewhat less undesirable wavelengths.

In accordance with another aspect of the invention there is provided an envelope assembly for a high intensity radiation apparatus. The assembly includes an inner envelope having an inside surface defining in part an arc chamber, and an outer envelope enclosing the inner envelope, the inner and outer envelopes defining in part therebetween a cooling chamber. The assembly further includes inlet and outlet spacers cooperating with inlet and outlet end portions of the inner and outer envelopes respectively to provide the cooling chamber extending therebetween, the spacers having conduits to conduct cooling liquid relative to the cooling chamber.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In drawings which illustrate embodiments of the invention,

Figure 1:
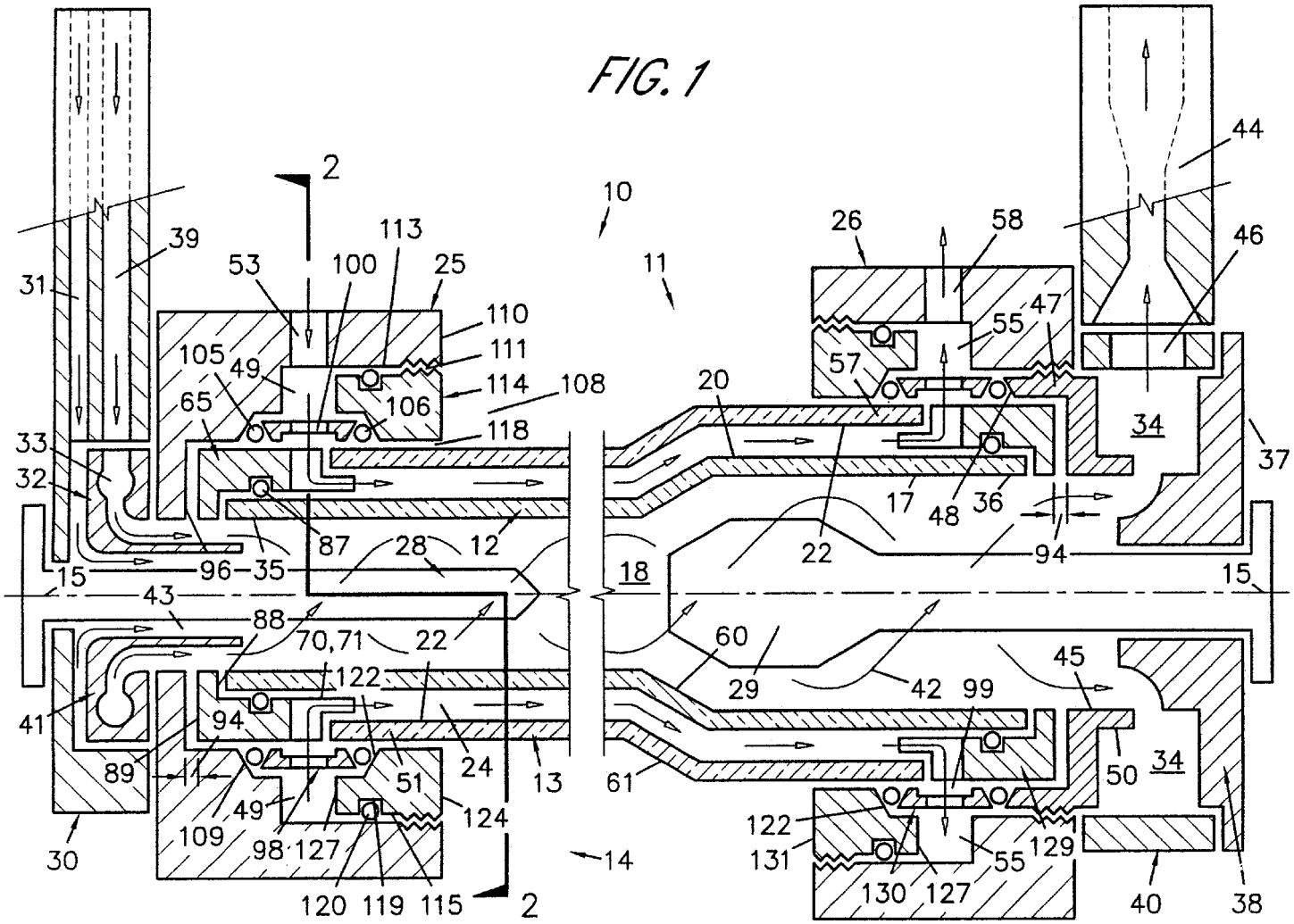
Figure 2:
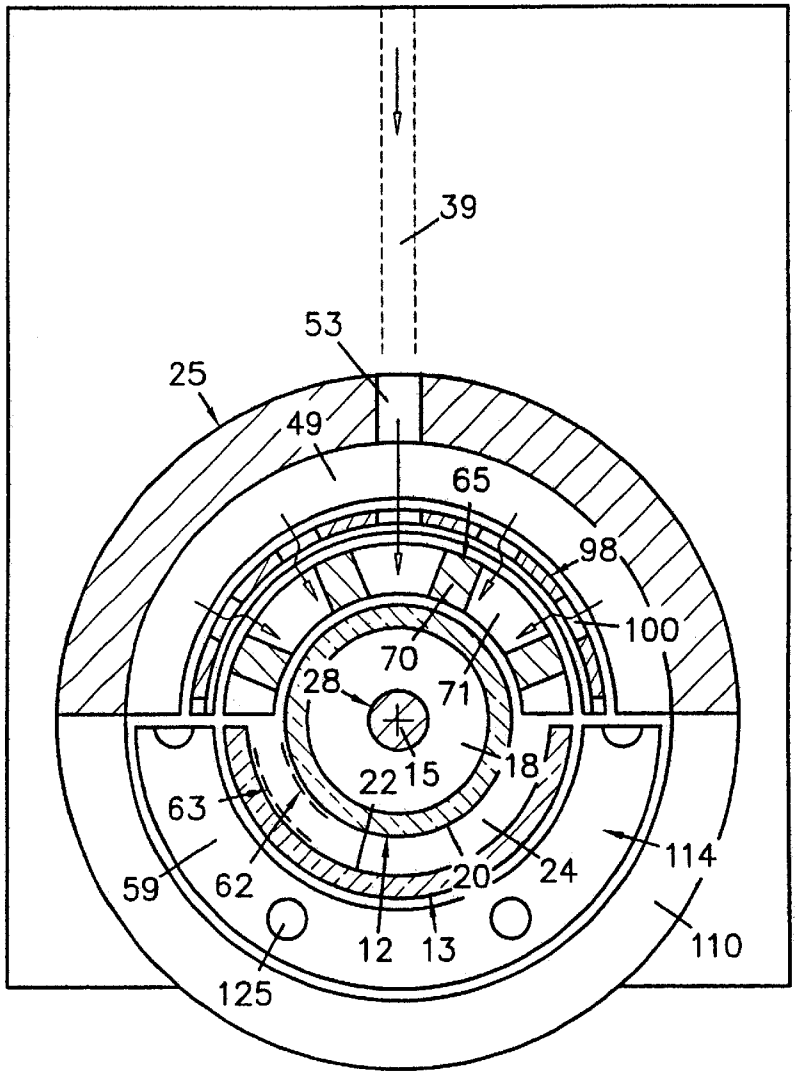
Figure 4:
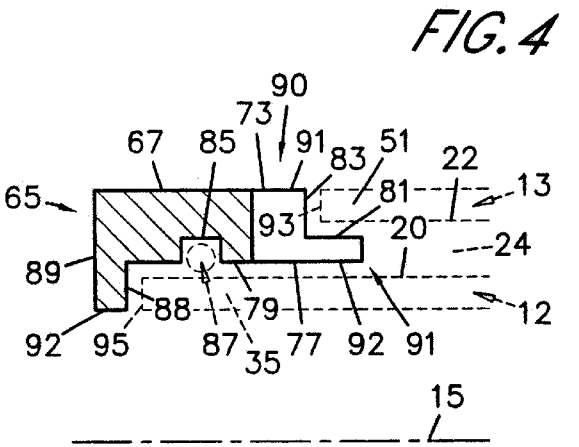
Figure 3:
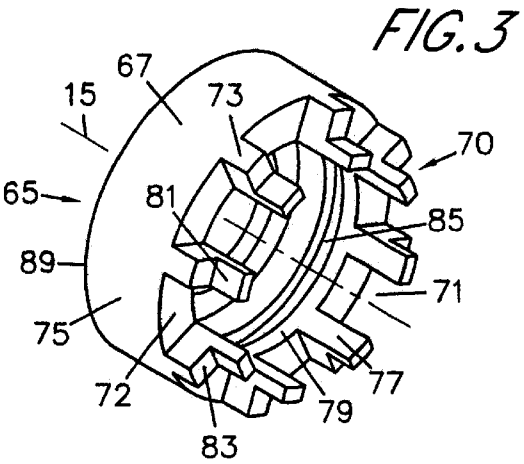
Figure 6:
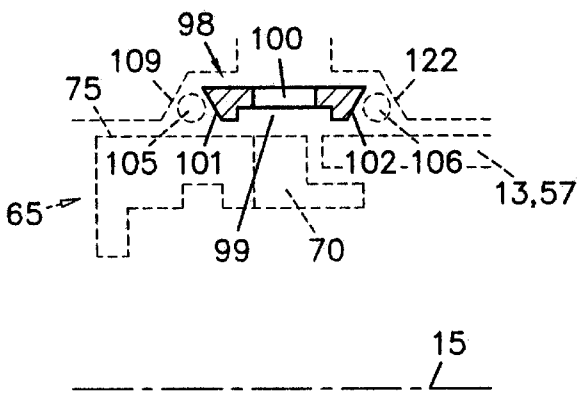
Figure 5:
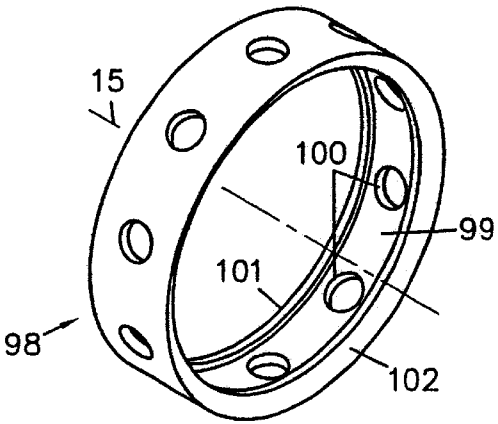
Figure 7:
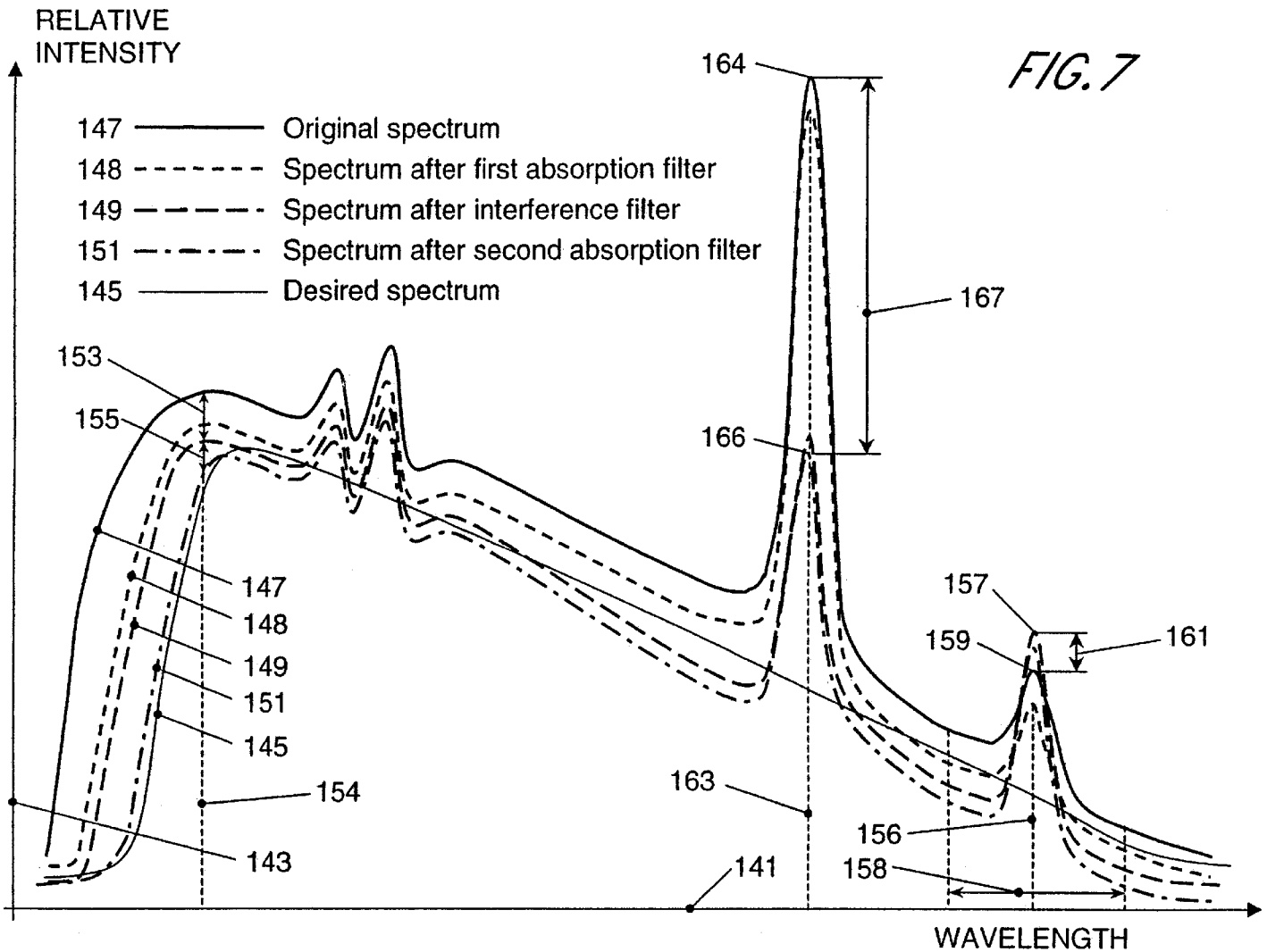

| | |
|---|---|
| FIG. 1 | is a fragmented partially diagrammatic longitudinal section through main portions of an apparatus for producing high intensity electromagnetic radiation according to a first embodiment of the invention, some details being omitted for clarity; |
| FIG. 2 | is a fragmented partially diagrammatic transverse section on line 2-2 of FIG. 1; |
| FIG. 3 | is a perspective of a spacer for spacing apart inner and outer envelopes of the apparatus shown in FIG. 1; |
| FIG. 4 | is a fragmented longitudinal section of a portion of the spacer FIG. 3 showing cooperation with the inner and outer envelopes; |
| FIG. 5 | is a perspective of a seal retainer of the apparatus shown in FIG. 1; |
| FIG. 6 | is a fragmented longitudinal section of a portion of the seal retainer of FIG. 5 showing cooperation between seals; and |
| FIG. 7 | is a graphical representation of selected radiation spectra to show a comparison between standard sunlight, a normal or unfiltered arc spectrum, and three sequentially filtered arc spectra. |

DETAILED DESCRIPTION

FIGS. 1 and 2

As shown in FIG. 1, an apparatus for producing high intensity electromagnetic radiation is designated generally by the reference character 10. The apparatus 10 includes a high intensity arc lamp shown generally at 11 having an inner envelope 12 cooled by a first flow of liquid along an inside surface 17 of the inner envelope. The arc lamp 11 includes first and second electrodes 28 and 29 for generating a high power plasma arc within the inner envelope 12, the arc emitting electromagnetic radiation. The apparatus 10 further includes a cooling device shown generally at 14 for producing a second flow of liquid in contact with an outside surface 20 of the inner envelope 12. The apparatus 10 also includes an outer envelope 13 surrounding the inner envelope 12 to define a cooling chamber 24 between the outside surface 20 of the inner envelope 12 and an inside surface 22 of the outer envelope 13.

In this embodiment, the inner and outer envelopes 12 and 13 include respective axially elongated cylindrical inner and outer tubes disposed concentrically about a longitudinal axis 15, the outer tube having a radius greater than that of the inner tube. The inside surface 17 of the inner envelope 12 defines in part an arc chamber 18 located within the inner envelope 12, which is also referred to as an arc tube. The envelopes 12 and 13 are commonly made of a highly refined quartz material specially adapted for high temperature applications associated with arc lamps. The annular cooling chamber 24 defined by the space between the surfaces 20 and 22 serves as a "water jacket" as will be described. The cooling device 14 includes an inlet housing 25 and an outlet housing 26 located adjacent opposite ends of the envelopes 12 and 13 to permit injection and removal respectively of liquid into and out of the cooling chamber, as will be described.

The first and second electrodes 28 and 29 are polarized so that the electrode 28 is a cathode and the electrode 29 is an anode. The electrodes are positioned co-axially within the arc chamber 18 and spaced axially apart therealong to sustain an arc. A cathode adaptor plate shown generally at 30 mounts the cathode 28 and an associated electrical conductor (not shown) in communication with the cathode. An anode housing 40 carries the anode 29 and an associated conductor (not shown) in communication with the anode.

An inner flow generator shown generally at 32 produces a first flow of liquid along the inside surface 17 of the inner envelope 12. In this embodiment, the inner flow generator 32 includes an arc chamber fluid inlet 33 formed in the cathode adaptor plate 30 located generally adjacent an inlet end portion 35 of the inner envelope 12 and an arc chamber fluid outlet 34 formed in the anode housing 40 located generally adjacent an outlet end portion 36 of the inner envelope 12. The cathode adaptor plate 30 mounts a gas delivery conduit 31 and an inlet conduit 39 for introducing gas and liquid respectively into the fluid inlet 33. The fluid inlet 33 receives a cooling liquid, preferably de-ionized water, from the inlet conduit 39. The inner flow generator 32 includes a vortex generator 41, shown schematically herein, which is preferably of a type disclosed in U.S. Pat. Nos. 4,700,102 or 4,937,490 incorporated herein by reference. The vortex generator is adapted to inject the cooling liquid into the arc chamber with a radial velocity component so as to generate a spiraling or vortexing motion as shown at 42 in the cooling liquid, to subject the liquid to centrifugal forces to cause it to flow along the inside surface 17 of the inner envelope. The cooling liquid is injected at relatively high pressure into the vortex generator 41.

The fluid inlet 33 also has a gas injector 43 adapted to inject an inert gas into the arc chamber to sustain the arc, the gas being preferably Argon, although other arc discharge gases could be substituted. The Argon is delivered to the injector 43 through the gas delivery conduit 31 and the injector injects the gas as a tubular flow around the cathode 28. The gas vortex is constrained to follow a spiraling or vortexing motion adjacent the axis 15 by the arc current and the vortexing flow of water along the inside surface 17 of the arc chamber. The Argon gas sustains a high intensity electrical discharge between the electrodes and is then discharged from the outlet end portion 36 of the arc chamber. The vortexing wall of liquid sweeping the inside surface 17 of the inner envelope 12 cools the envelope 12 internally and the arc itself, permitting attainment of higher power than would otherwise be possible. It can be seen that the internal liquid vortex not only provides cooling of the inner envelope 12, but also essentially prevents contamination from products generated during the arc discharge.

The fluid outlet 34 delivers a mixture of gas and liquid from the inner envelope 12 to a fluid exhaust structure 44. The fluid outlet 34 is an annular manifold extending around an anode insertion ring 45 which in turn extends around the outlet end portion 36 of the inner envelope 12. The anode insertion ring passes liquid from the arc tube into the annular manifold. The mixture of gas and liquid is drawn through a venturi in the exhaust structure 44 and passes to a sump which permits separation of the gas and liquid for re-circulation. The outlet housing 26 includes an access assembly 37 which provides easy access to the anode 29 and to the envelopes 12 and 13 to facilitate replacement thereof as required. The access assembly 37 includes an anode base 38 and the anode insertion ring 45, the housing and base being connected to the anode housing 40 by releasable connectors (not shown) to permit easy removal and re-assembly.

The anode base 38 has a central opening to receive the anode 29 therethrough, and to locate the anode with respect to the outlet housing 26 and the envelope 12. In addition, the anode base provides an annular wall for the fluid outlet 34, and thus is sealed against fluid leakage past the anode and anode housing 40 by conventional seals, not shown. The anode housing has a discharge opening 46 which aligns with the exhaust structure 44 to discharge the mixture of liquid and gas therethrough.

The anode insertion ring 45 has an annular rim which is generally Z-shaped in cross section as shown, and has a large annulus 47 having a male screw thread which engages with a complementary female screw thread of the outlet housing 26 to retain the insertion ring in place. The large annulus has a truncated conical seal surface 48 which cooperates with an outer seal as will be described. The anode insertion ring 45 has a small annulus 50 which has an inside surface generally concentric with the inside surface 17 of the inner envelope 12 so as to provide a smooth passage therewith into the fluid outlet 34. Other aspects of the outlet housing 26 are generally similar to corresponding aspects of the inlet housing 25 and are not described in detail.

An advantageous aspect of the present embodiment of the invention relates to addition of the water jacket which cools the outside surface 20 of the inner envelope 12 and the inside surface 22 of the outer envelope 13 by providing a second flow of cooling liquid to the apparatus through the cooling chamber 24. For commercial reasons, it is preferable that at least one embodiment of the present invention can be "retro-fitted" to an existing high intensity radiation apparatus. Consequently, structure of the present embodiment of the invention can cooperate with existing inlet and outlet housings of some prior art apparatus of the applicants. This enables owners of existing high intensity arc lamps to update their equipment to incorporate advantages of the present embodiment of the invention in which the inner envelope 12 is cooled externally which, in combination with internal cooling of the inner envelope 12 due to the vortexing liquid flow, reduces the temperature gradient across the envelope wall, and thereby reduces thermal stresses in the envelope. The second cooling flow can be a generally axial flow along the envelope without any necessity for injecting a vortexing flow in the external cooling liquid. In this example, and for some retrofit applications, liquid supplied to the cooling chamber 24 is maintained separate from liquid supplied to the arc chamber 18, but this is not necessary.

In this embodiment, the cooling device 14 shown in FIG. 1 includes a cooling chamber liquid inlet 49 and a cooling chamber liquid outlet 55 for directing a second flow of liquid to flow through the cooling chamber 24. More particularly, the inlet housing 25 of the cooling device 14 includes the annular cooling chamber liquid inlet 49 located adjacent an inlet end portion 51 of the outer envelope 13. The cooling chamber liquid inlet communicates with a cooling chamber inlet conduit 53 to receive cooling liquid, preferably de-ionized water, therefrom. Similarly, the outlet housing 26 of the cooling device includes the annular cooling chamber liquid outlet 55 located adjacent an outlet end portion 57 of the outer envelope 13 which communicates with an outlet conduit 58 provided in the housing 26. Conduits, not shown, interconnect the arc chamber inlet conduit 39, the gas delivery conduit 31 and the exhaust structure 44 through a recirculating system (not shown) which includes a filter, a heat exchanger for cooling the liquid, a reservoir for separating the liquid and gas, and a pressurizing pump to re-circulate cooling liquid through the heat exchanger back to the vortex generator and to re-circulate gas back to the gas injector for re-use therethrough. The inlet conduit 53 and the outlet conduit 58 of the annular cooling chamber 24 are similarly interconnected with a separate recirculating system (not shown) including a filter, a heat exchanger for cooling and a pressurizing pump to re-circulate the cooling liquid back to the inlet conduit 53.

It is also added that the present embodiment of the invention locates the inlet to the inner envelope 12, and the inlet to the outer envelope 13 at the same ends of the apparatus, i.e. within the inlet housing 25. This is not necessary and depends on design requirements, as well as orientation of the lamp with respect to the horizontal. To purge gas bubbles from cooling liquid in the annular cooling chamber 24, if the longitudinal axis 15 is not horizontal, preferably the inlet for the cooling chamber 24 is located adjacent a lower end of the apparatus.

The outlet end portions 36 and 57 of the inner and outer envelopes 12 and 13 respectively are of larger diameters than the corresponding inlet end portions 35 and 51 respectively. These larger diameters provide adequate clearance around the anode 29 for passage of cooling water and gas with little chance of water inadvertently splashing the anode 29. The inner and outer envelopes 12 and 13 have expansion portions 60 and 61 respectively in which the walls of the envelopes pass through short, generally parallel, truncated conical sections to provide smooth transitions between smaller and larger diameters. The centrifugal force imposed on the vortexing water flow along the inside surface 17 of the envelope 12 ensures that the vortexing water flow follows the expansion portion 60 without undue flow separation therefrom.

FIGS. 1 Through 4

There is considerable difficulty in maintaining close dimensional tolerances when manufacturing arc tubes, particularly thin-walled glass or quartz tubes such as those which serve as the inner and outer envelopes in the present embodiment. In addition, such tubes must be well sealed with respect to inlet and outlet housings of the tubes to ensure that relatively high pressure cooling water or gas cannot leak from the apparatus. Sealing problems are compounded when it is necessary to seal the two tubes of the present embodiment, each of which has a relatively wide manufacturing dimensional tolerance which must be accommodated by this seal structure. In addition, arc tubes and other transparent surfaces subjected to high intensity radiation must be kept exceptionally clean to reduce local "hot spots" arising from contamination, which increases heat absorption. Thus, it is essential to design a tube structure which permits easy installation and removal of tubing and sealing thereof with minimal handling of the tubes. The present embodiment provides a new and simplified tube assembly and seal structure which enables easy installation and removal of the tube assembly from the apparatus, which can be performed quickly with negligible chances of contamination of the tubes due to handling.

The descriptions relating to FIGS. 3 and 4, and subsequently to FIGS. 5 and 6, relate to the inlet housing 25 and the inlet end portions of the inner and outer envelopes. The outlet housing 26 has functionally similar structure associated therewith, but of a larger size so as to accommodate a larger diameter at the outlet end portions of the inner and outer envelopes. In addition, the outlet housing 26 cooperates with the access assembly 37 which is substituted for some portions of the inlet housing 25 to provide functionally similar structure to cooperate with sealing structure associated with the envelopes as will be described. Otherwise, the inlet and outlet housings 25 and 26 are essentially similar to each other with equivalent components performing equivalent functions, with the exception of the direction of fluid flows relative to the housing.

The inlet housing 25 has a spacer 65 which cooperates with the adjacent end portions 35 and 51 of the inner and outer envelopes 12 and 13 to provide the annular cooling chamber 24 therebetween as follows. As best seen in FIG. 3, the spacer 65 has an annular body portion 67 having a plurality of axially extending fingers 70 disposed circumferentially equally around a partially annular intermediate face 72 of the spacer. The spacer has a plurality of clearance spaces 71, one space being located between each of the fingers 70. The spaces serve as conduits to conduct cooling fluid relative to the cooling chamber as will be described. The fingers are essentially identical to each other, and thus portions of typical fingers will be described in detail. Each finger 70 has a finger outer face 73, which is convex and generally concentric with a cylindrical body outer face 75, and a finger inner face 77 which is concave and generally concentric with an annular body inner face 79. The finger has a convex intermediate face 81 generally adjacent an end portion of the finger, with an intermediate shoulder 83 extending perpendicularly between the intermediate face 81 and the finger outer face 73. The body inner face 79 has an annular seal groove 85 extending therearound and receiving an O-ring inner seal 87 therein (the seal not shown in FIG. 3). The spacer 65 has flat, parallel inner and outer annular end faces 88 and 89, and a concave annular face 92 which together form an annular rim projecting inwardly from the inner face 79 towards the axis 15. The face 89 is spaced at an axial spacing or clearance 94 from an oppositely facing end face 96 of the inlet housing, the clearance 94 providing expansion allowance as will be described.

The fingers 70 are disposed symmetrically about the longitudinal axis 15 and are dimensioned so that the convexities of the intermediate faces 81 are concentric with the axis 15 and with the inside surface 22 of the outer envelope 13. Thus as seen best in FIG. 4, the inlet end portion 51 of the envelope 13 is located radially by engaging the intermediate faces 81 and located axially by engaging the intermediate shoulders 83 of the fingers. The body inner face 79 and finger inner faces 77 are located on an annular surface slightly greater than the outside surface 20 of the envelope 12 so as to be a snug fit thereon. To enable the inner seal 87 to provide adequate sealing between the spacer 65 and the inner envelope, the snug fit of the inner face 79 on the outside surface 20 is "customized" by machining to accommodate manufacturing tolerances of the envelope 12. Thus, it can be seen that the spacer has an inner annular face, namely the body inner face 79 which is generally complementary to the inner envelope and is adapted to locate the inner seal 87 which cooperates with the inner envelope to seal thereagainst.

Thus it can be seen in FIG. 4 that each finger has respective proximal and distal portions 90 and 91 respectively separated by the intermediate shoulder 83, the proximal portion having a radial depth greater than radial depth of the distal portion by radial depth of the intermediate shoulder. The inner surface 22 of the outer envelope 13 is received on the distal portions 91 of the fingers which locate the end portion 51 of the envelope 13 radially. The envelope 13 has an annular rim 93 which is located generally adjacent the intermediate shoulder 83 to locate the envelope axially. In this embodiment, the envelope 13 has a wall thickness approximately equal to the radial depth of the intermediate shoulder 83. Also, the inner envelope 12 is embraced by the plurality of fingers which are sandwiched between the inner and outer envelopes to space the inner and outer envelopes radially apart to define the annular cooling chamber 24 therebetween. The inner envelope 12 has an annular rim 95 which engages the inner annular end face 88 of the spacer, which face has a radial depth equal approximately to wall thickness of the envelope 12. Thus, it can be seen that the envelopes 12 and 13 are located axially by respective rims thereof which are closely adjacent or contact the end face 88 and the intermediate shoulder 83 respectively. To accommodate manufacturing tolerances, small axial clearance gaps can exist between the rims of the envelope and the complementary contacting face depending on temperature. In addition, it is evident that the inner face 79 of the spacer annular body portion 67 locates the inner seal 87 which cooperates with the inner envelope 12 to seal thereagainst. The inlet housing 25 on the cathode side of the envelope, and the anode insertion ring 45 on the anode side, serve to locate the inner and outer envelopes and the spacers with respect to each other. Also, the envelopes 12 and 13, the spacer 65 at the inlet end portions thereof, (which serves as an inlet spacer) and an equivalent outlet spacer of the outlet housing 26 cooperating with the outlet end portions of the inner and outlet envelopes (see FIG. 1) provide a unitary envelope assembly or unit for the radiation apparatus. This assembly can be easily handled as a unit for installation and replacement as required with negligible chance of contamination during such procedures.

FIGS. 1, 2, 5 and 6

The inlet housing 25 further comprises a seal retainer 98 which is annular and encloses a portion of the spacer 65 and the inlet end portion 51 of the outer envelope 13. As best seen in FIGS. 2 and 5, the seal retainer has a plurality of circular conduit openings 100. In this embodiment, the conduit openings have diameters approximately equal to the clearance spaces 71 between opposed faces of the fingers 70 (FIG. 3), however, this is not a necessary feature. An annular cavity/liquid manifold 99 extends along an inner surface of the seal retainer 98 and acts as a conduit to provide clearance for liquid to flow through the seal retainer 98 and through the spaces 71 between the fingers 70 of the spacer and thus into the annular cooling chamber 24, regardless of the alignment or misalignment of the conduit openings 100 relative to the clearance spaces 71.

As best seen in FIGS. 5 and 6, the seal retainer has first and second axially spaced apart annular end faces 101 and 102 which cooperate with first and second outer seals 105 and 106 respectively. The seals 105 and 106 are conventional O-ring seals which snugly fit around the body outer face 75 of the spacer 65 and around an outer surface of the inlet end portion 51 of the outer envelope 13 respectively. The end faces 101 and 102 are truncated conical faces which are inclined at respective conical angles inwardly and towards each other as best seen in FIG. 6, the angles being about 15 degrees to a radial plane. Alternatively, other angles, preferably between about 5 and 30 degrees, may be substituted.

Referring to FIG. 1, the inlet housing 25 has an axially inwardly facing recess 108 with a housing seal face 109 located at an inner end of the recess, the seal face being truncated conical and disposed at a conical angle which is generally similar to the angle of the second end face 102 of the seal retainer 98, as shown in FIG. 6. The first outer seal 105 is located between the first end face 101 of the seal retainer and the housing seal face 109, which are disposed at generally equal but oppositely inclined conical angles so as to provide a radially inwardly diverging groove to receive the O-ring seal 105 therebetween. The recess 108 has a rim portion 110 having a female screw thread 111 disposed axially outwardly from an annular seal engaging surface 113.

The inlet housing 25 further includes an annular compression ring 114 which has a cylindrical outer surface 115 having a male screw thread complementary to the female screw thread 111 of the inlet housing. The outer surface 115 has an annular seal groove 119 therein containing a housing seal 120, which in this embodiment includes a conventional O-ring seal which engages the seal engaging surface 113 of the inlet housing to provide a seal therewith when the threads are engaged. The compression ring 114 has an annular opening 118 which is a clearance fit to enclose the outer envelope 13 without interference. The annular compression ring 114 has a ring seal face 122 which is truncated conical and inclined at a conical angle similar to that of the first end face 101 of the seal retainer. Thus, the second outer seal 106 is located axially between the second end face 102 of the seal retainer and the ring seal face 122 of the annular compression ring 114, which diverge radially inwardly and compress the seal therebetween. Thus, as best seen diagrammatically in FIG. 6, the truncated conical seal faces 109 and 122, shown in broken outline, cooperate with first and second outer seals 105 and 106 respectively which are located on opposite sides thereof by the similar complementary end faces 101 and 102 of the seal retainer 98.

The annular compression ring 114 also has a main annular face 124 with at least one pair of diametrically opposed tooling openings 125 (shown partially in FIG. 2) which are adapted to receive a turning tool, not shown, which applies torque to the annular compression ring 114 to rotate the ring on the screw threads so as to move the ring inwardly with respect to the inlet housing 25. Inward movement of the annular compression ring 114 increases compression forces between the outer seals 105 and 106, mainly due to the radially inwardly diverging faces 101 and 109, and 102 and 122 respectively. This movement increases inwardly directed compression forces on the outer seal 105 and the spacer 65, and on the outer seal 106 and the outer face of the outer envelope 13, thus augmenting sealing therebetween. Inward movement of the annular compression ring 114 thus generates an increase in sealing force of the O-rings on their complementary surfaces, namely the two truncated conical surfaces and the cylindrical surfaces.

As best seen in FIG. 6, these two truncated conical surfaces and one cylindrical surface which enclose the O-ring seal are disposed in a generally isosceles triangular configuration in which length of the base of the triangle is gradually reduced as the compression ring is screwed inwardly, which enhances sealing on all three surfaces. The size of O-ring and length of each of the truncated conical surfaces are selected such that the ring can move inwardly into the recess 108 of the inlet housing 25 sufficiently to accommodate the normal manufacturing dimensional tolerances of the inner and outer envelopes 12 and 13. A conventional O-ring fitted in a conventional rectangular-sectioned O-ring groove of fixed dimensions is relatively limited in the range of dimensional tolerances it can accommodate, and would not be appropriate in the present application for sealing the outer envelope 13. Thus it can be seen that the compression ring cooperates with the outer seals to apply force thereto to augment sealing between the outer envelope and the housing. In addition, as the seal retainer 98 is, in effect, a floating ring, each of the seals 105 and 106 is compressed with equal force. Preferably, both outer seals 105 and 106 are compressed in this manner, although in an alternative design, there might be adequate sealing attained with just one outer ring being so compressed.

As seen in FIG. 1, the annular compression ring 114 has an inner annular face 127 which, when the ring is screwed into the housing sufficiently to seal the envelopes, is spaced from an opposing annular face of the inlet housing to provide an annular manifold which serves as the cooling chamber liquid inlet 49 and communicates with the inlet conduit 53 to receive cooling liquid. As seen in FIG. 2, the annular manifold or inlet 49 extends circumferentially around the seal retainer 98 to provide fluid communication with the openings 100 in the seal retainer, which openings in turn communicate with the clearance spaces 71 between the fingers 70 of the spacer. Thus the cooling liquid supplied to the conduit 53 is distributed circumferentially around the housing by the annular manifold of the inlet 49 and passes smoothly and essentially continuously through the annular cooling chamber 24.

The description above relates primarily to the sealing structure associated with the inlet housing 25. As previously mentioned, there are structural differences between the inlet housing 25 and the outlet housing 26, most differences relating to the additional sizes of the envelopes, and the access assembly 37. The outlet housing 26 contains a spacer 129 and a seal retainer 130 which are proportionately larger than, but functionally identical to, the spacer 65 and seal retainer 98 respectively of the inlet housing. The outlet housing 26 has undesignated inner seals and outer seals which cooperate with the envelopes 12 and 13 and associated structure generally as in the inlet housing. An annular compression ring 131, similar to the annular compression ring 114, cooperates directly with one of the outer seals as previously described, whereas the truncated conical seal surface 48 of the anode insertion ring 45 cooperates directly with the remaining outer seal in a manner similar to the housing seal face 109 of the inlet housing. It can be seen that the outer seals of the outlet housing 26 are thus fitted between opposed truncated conical surfaces, each of which are mounted on threaded components which engage threads of the outlet housing 26.

It can be seen that the access assembly 37 permits easy removal and replacement of the envelope assembly by simplifying removal of the anode base 38 and associated anode 29, followed by removal of the insertion ring 45 which permits easy access to the envelope assembly and associated seals.

FIGS. 2 and 7

Another advantageous aspect of the present embodiment of the invention relates to approximating a desired radiation spectrum. For this purpose, the apparatus 10 includes an energy redistributor shown generally at 59 in FIG. 2, for redistributing energy within a first radiation spectrum generated by the arc to produce a second radiation spectrum. More particularly, the energy redistributor 59 includes a partially reflecting optical filter 62 for reflecting a first portion of energy at a first waveband centered about a strong line of the first radiation spectrum back into the arc, to cause the arc to re-emit at least some of the first portion of energy at a second wavelength outside the first waveband, as explained below. In this embodiment, the energy redistributor includes one or more selective optical filters cooperating with the inner envelope 12, and optionally the outer envelope 13, to filter selective radiation wavelengths from radiant energy generated directly by the arc, referred to herein as a first radiation spectrum.

A plasma arc generates a wide range spectrum of radiation wavelengths including wavelengths in and beyond opposite ends of the visible spectrum. In one particular application of the present invention, in order to test solar cells, radiation emitted by the arc is filtered to closely approximate to the normal spectrum of sunlight at the earth's surface, hereinafter referred to as "standard sunlight". In other applications, it might be preferable to generate a spectrum which approximates closely to sunlight at the outer edge of the earth's atmosphere, for example, and thus simulate space conditions for solar cells mounted on space vehicles. In any event, it is desirable to completely filter wavelengths that are not found in sunlight from the normal arc spectrum, and also to attenuate other wavelengths so as to more closely match the relative intensities of the various wavelengths of radiation found in sunlight.

This selective filtering can be accomplished by coating at least one surface of at least one envelope with an appropriate optical filtering material, such as interference filtering material or any other suitable partially reflecting material. Although such reflective coatings would normally overheat when applied to a conventional water wall or other high intensity arc lamp, causing the coating to burn and possibly causing the envelope to overheat and break, the additional cooling effects provided by the liquid flows on both sides of the inner envelope 12 serve to overcome these difficulties, thus permitting such coatings to be applied to the arc lamp 11.

Referring to FIG. 2, first and second partially reflecting optical filters 62 and 63 are shown schematically on the inner and outer envelopes 12 and 13 respectively. In the present embodiment, depending on the type of filtering material and characteristics of the plasma arc, energy of certain dominant wavelengths that are reflected at least partially by the filter back into the plasma arc can be re-emitted as other wavelengths, sometimes with enhanced intensity, and can then pass the filter to more closely approximate to a desired spectrum.

FIG. 7 shows a sample group of selected wavelengths within a range from about 250 nm through 1000 nm, displayed along a horizontal axis 141, while relative intensity is displayed along a vertical axis 143. Alternatively, it will be appreciated that other desired wavelength ranges may be selected. In this particular application, the normal radiation spectrum emitted directly by the arc of the apparatus 10 is filtered sequentially by three distinct filters to produce a final filtered spectrum which approximates to standard sunlight which is designated 145 in FIG. 7.

An unfiltered Argon arc generates a spectrum shown partially as a curve 147 in FIG. 7, which is inevitably modified by absorption as the radiation passes through the vortexing layer of water on the inside surface 17 of the envelope 12. Water absorbs wavelengths above approximately 1400 nm, which is higher than the range of wavelengths shown on the graph of FIG. 7, and thus water absorption of radiation is not shown graphically herein. The material of the inner envelope 12 inherently absorbs some radiation (mostly ultraviolet) and thus serves as a first absorption filter. If desired, it is possible to increase the amount of energy absorbed in the material of the inner envelope 12, for example by "doping" the envelope material with specific ingredients to selectively absorb additional specific wavelengths. In any event, the inner envelope 12 serves as a first absorption filter and produces a curve 148 following this first radiation absorption.

The partially reflecting optical filter 62 transmits selected wavelengths and rejects other wavelengths which are reflected back into the arc. Reflecting rejected wavelengths back into the arc permits "smoothing" of a final radiation spectrum emitted by the apparatus. The term "smoothing" refers to a process in which the selective, highly intense or dominant wavelengths, often termed "strong line emissions", cannot pass through the filter and are reflected for absorption in the plasma. In specific circumstances, the absorbed energy of the rejected strong lines can be re-emitted at one or more different wavebands which might pass the filter on a second or later re-emission from the plasma. Reflecting radiation back into the arc reduces energy losses because the reflected radiation energy is partly absorbed and re-emitted by the arc at sufficiently different wavelengths to pass through the filter and thus pass through the cooling chamber 24 and out of the apparatus 10. The partially reflecting optical filter is thus preferable to an absorbing optical filter because reflecting rejected wavelengths back into the arc reduces absorption of radiation into the material of the arc tube or envelope itself, thus reducing undesirable heating of the arc tube.

The partially reflecting optical filter 62 may include an interference filter such as a thin film of multi-layer coatings used for heat control in high power optical systems, and such filters are available from many industrial suppliers. Suitable interference filters are sold under the registered trade-mark "HeatBuster", a trade-mark of Deposition Sciences Incorporated of California, U.S.A. Alterative partially reflecting optical filters can be substituted, such as "semi-silvered" mirrors, for example, which reflect some radiation and transmit other radiation. Whichever type of partially reflecting optical filter is used, because filtering is inevitably imperfect, some heat is also absorbed by the partially reflecting optical filter itself, and this in turn contributes to the heat that is also absorbed by the tube or envelope itself, upon which the filter coating is deposited.

Referring back to FIG. 2, the inner envelope 12 is swept by cooling water on both sides thereof, whereas the outer envelope 13 is swept on only one side thereof. Thus, the inner envelope is better cooled than the outer envelope, and more heat can be removed therefrom. Also, because the cooling of the inner envelope 12 takes place on both surfaces, differential stresses in the inner envelope 12 due to thermal gradients across the wall of the envelope are less than those in the outer envelope 13. If all the necessary filtering of the arc can be performed by a single partially reflecting optical filter, this filter is preferably located on the inner envelope 12 as shown partially and diagrammatically on the outside surface 20 of the envelope 12. The filter for the inner envelope 12 is preferably not located on the inside surface 17 of the envelope 12 as that surface is subjected to a relatively high rate of water flow in the vortexing flow of fluid which may erode the filter, and is also exposed to potential contamination generated by the arc. The filter 62 is in addition to the inherent absorption filtering of the material of the envelope 12, which is termed a first absorption filter. Hereinafter and in the claims, a combination of the partially reflecting optical filter (e.g. interference filter) 62 and the inherent absorption filtering of the material of the envelope 12 is termed an "inner optical filter". This is the preferred embodiment which simplifies cooling and other factors. However, if necessary, the second partially reflecting optical filter 63 can be provided on the outer envelope 13, in addition to the inherent absorption filtering of the glass or material of the outer envelope 13.

The first and second partially reflecting optical filters 62 and 63 are shown extending over a relatively small percentage of the circumference of the envelopes 12 and 13 respectively, for convenience of illustration only. In many applications, the filters would extend over the entire exposed surface areas of the envelopes. However, in some applications, it may be more appropriate to apply the optical filters over less than the complete circumferences of the envelopes and, in some circumstances, over less than the complete lengths of the exposed envelopes. These specific applications can be accommodated by selective application of the optical filters, either by specific application of coatings for partial reflecting filtering, and/or by doping adjustments to enhance inherent absorption filtering of the envelope material.

As the outer envelope 13 is subjected to less efficient cooling than the inner envelope 12, it is preferable that a significantly larger portion of the filtering takes place on the inner envelope 12 than on the outer envelope 13. Also, if a relatively large portion of reflecting filtering takes place on the outer envelope 13, additional complications can arise due to inward reflections of rejected wavelengths from the second filter back towards the first filter and the arc itself. If inward reflections were to occur to any large degree, complex repeated reflections could occur between the first and second filters across the annular cooling chamber 24 and results would be difficult to predict. Consequently, only relatively small portions of reflecting filtering should take place on the outer envelope 13, if absolutely necessary. If additional filtering is required on the outer envelope 13, preferably such filtering should be enhanced absorption filtering, e.g. by doping, so as to reduce the complexities of rejected wavelengths being reflected back into the annular cooling chamber as described above. The term "outer optical filter" refers to any filter associated with the outer envelope 13, which would include the inherent absorption filtering of the glass material, plus any enhanced absorption from doping, and/or the partially reflecting optical filter 63.

If a second partially reflecting optical filter is required, it is preferably located on the inside surface 22 of the envelope 13 as shown. If an optical filter were provided on an outside surface of the outer envelope 13, it would be prone to atmospheric contamination, accidental mechanical damage during handling or other factors. Thus, the first and second partially reflecting filters 62 and 63 are preferably located on the oppositely facing surfaces of the annular cooling chamber 24 so that the optical filters are swept by relatively slow moving cooling liquid in the annular cooling chamber 24 and thus less likely to deteriorate.

OPERATION

FIG. 7

The present embodiment of the invention advantageously enables a wide range of filtering applications which would not have previously been possible with conventional high intensity arc lamps such as water wall arc lamps. While a specific example of generating simulated sunlight is described, many different types of spectra can be approximated with the present apparatus, depending on the selection of the partially reflecting optical filter(s), the absorption filter(s), the plasma characteristics which are based on the pressure and temperature of the gas, and the type of gas itself. It is particularly important to select the appropriate interference filters for the appropriate operating parameters of the plasma arc itself. Design considerations of such selection are known, provided the designer is aware of the important factors that must be considered when selecting the appropriate combination of filters and gas operating parameters, as briefly described below. Custom made filters tailored for specific user applications may be obtained from a number of commercial suppliers, such as DSI Deposition Sciences Incorporated for example, who will design an appropriate filter upon receiving relevant transmission curve information from the user.

In any plasma arc, certain wavelengths of the spectrum will be characterized by "strong lines" which represent exceedingly high relative intensities of specific wavelengths with respect to remaining wavelengths in the spectrum. FIG. 7 is a simplified graphical representation of a portion of a spectrum in which the strong lines are shown with their relative intensities reduced by many orders of magnitude, and in which relative "widths" and separations of the lines are widened for clarity. To obtain a final radiation spectrum which approximates to the curve 145 representing standard sunlight, most strong lines must be "smoothed" by a specific interaction of the present embodiment of the invention, which occurs between the interference filter and the absorbing plasma arc. This interaction is an advantageous mechanism for synthesizing a desired or final radiation spectrum from an initial or starting radiation spectrum, and is dependent on mathematical probabilities of absorption of particular radiation wavelengths into the plasma arc, and subsequent re-emission of energy released by the arc following the absorption. The absorption probability in the hot plasma core for a particular wavelength of the emitted spectrum is proportional to the emission strength of the respective wavelength. Therefore, in this particular application, the probability of absorption within the plasma of a strong line emission after being reflected back into the plasma by means of an interference filter is proportional to the relative intensity of the emission. This mechanism effectively prevents strong lines from passing through the interference filter at full original intensity. After absorption by the plasma, the energy of the strong lines can be re-emitted, and if again rejected by the filter, can once again be reflected back into the plasma for probable re-absorption and re-emission. This repeating sequence of reflection, absorption into the plasma arc and re-emitting is termed "iterative reflections", and at each repetition, there is a reduction of the relative height of the strong line emission, as seen in FIG. 7.

Two main photon emission mechanisms in the plasma serve to transfer energy from the absorbed strong lines into other wavelengths. Some of the strong line energy absorbed by the plasma will be re-emitted on other "weaker lines" or different lower intensity wavebands. This process is referred to herein as "shifting". In addition, some of the absorbed strong line energy increases the speed of random electron motion in the plasma, or in other words, increases the temperature of the plasma. This process of absorption and resulting increased plasma temperature, called "thermalization", increases the intensity of the total continuum of radiation emitted by the arc. Effectively, therefore, energy in the strong lines is reflected back to the arc and is redistributed across the entire spectrum of arc radiation, thereby decreasing the strength of the strong lines relative to the arc emission spectrum.

When the apparatus is operating, the unfiltered arc generates the first radiation spectrum or curve 147 which is subjected to sequential filtering by the inner and outer filters, as follows. Unfiltered radiation from the arc passes through the inner filter of the inner envelope 12, namely, the first absorption filter of the tube material itself and the first partially reflecting optical filter 62 provided on the outside surface of the envelope. This combination of filtering produces a second radiation spectrum, shown as a curve 149, which passes into the cooling chamber 24. In the graphical example of FIG. 7, the second partially reflecting optical filter 63 is not used, and thus the second radiation spectrum is subjected only to inherent absorption filtering as it passes through the second absorption filter of the material of the outer envelope 13 to generate a third radiation spectrum, shown as a curve 151, which passes outwardly from the apparatus. It can be seen that the waveform of the first radiation spectrum 147 from the direct arc is modified in at least three sequential stages as it passes the inner filter (i.e. inherent absorption filter and interference filter) and then the outer filter (the material of the outer envelope 13). At each stage of filtering the spectrum is modified to approximate more closely to the normal or standard sunlight spectrum 145, subject to the aforementioned process of "shifting", which is described in further detail below. If a second partially reflecting optical filter 63 were provided on the outer envelope 13, an additional curve could be shown on FIG. 7, but this additional filter and resulting curve are omitted for clarity.

FIG. 7 also provides a visual representation of the degree of filtering which takes place on each of the filters. This can be ascertained by comparing vertical separation between two curves for a given wavelength. For example, a first vertical separation 153 represents relative intensity between the first radiation spectrum 147 and the second radiation spectrum 149 for a specific mean waveband 154 to represent radiation having passed through the inner filter associated with the inner envelope 12. The separation 153 is greater than a second vertical separation 155 between the second radiation spectrum 149 and the third radiation spectrum 151 (for the same mean waveband 154), after passing through the outer filter and away from the apparatus. The vertical separation between the curves 151 and 147 on either side of the curve 149 is not constant for the selected wavelengths.

As shown in FIG. 7, as mentioned above, iterative reflections can increase final relative intensity at some particular wavelengths in the curve 151, over corresponding wavelengths in the unfiltered curve 147. A typical dominant waveband 163 centered about a strong line of the original arc spectrum 147 has energy with a peak intensity 164 (shown considerably reduced for convenience of illustration). The first partially reflecting optical filter 62 reflects a first portion of energy at the waveband 163 back into the arc, to cause the arc to re-emit at least some of the first portion of energy at a second wavelength outside the first waveband 163, due to the two effects described above. Because the filter is partially reflecting, the filter also allows a second portion of energy at the first waveband to pass therethrough. Because some energy from the rejected waveband 163 was reflected and absorbed by the plasma arc, the same waveband 163 was ultimately transmitted with a peak 166 of a considerably attenuated intensity. Vertical separation between the peaks 164 and 166 shows a relatively large degree of intensity reduction 167.

Some of the original energy at the strong line waveband 163 absorbed into the arc is re-emitted by the arc at wavelengths outside the waveband 163. The partially reflecting optical filter 62 allows at least some of this re-emitted energy at other wavelengths to pass therethrough and therefore some of this re-emitted energy will ultimately pass through the inner and outer optical filters to emerge from the apparatus 10. Some of this re-emitted energy is thermalized and spread across the entire spectrum as previously described, while other portions of the absorbed strong line energy may be shifted, or in other words re-emitted at particular weak lines of the spectrum. For example, FIG. 7 shows a weaker mean waveband 156 or weak line in which the final curve 151 has an enhanced waveband peak 157 having a higher relative intensity than an original waveband peak 159 of the original arc spectrum or curve 147. Vertical separation between the peaks 157 and 159 of the curves 151 and 147 is defined as degree of intensity enhancement 161 which, in this instance, actually increases the peak intensity of that specific waveband 156 even further beyond the desired spectrum of curve 145. Thus the weak line peak is even more intense relative to the desired spectrum after enhancement than before enhancement, as a result of re-emission of at the weak line wavelength of energy absorbed into the arc from the strong line or dominant waveband 163 of the original spectrum, which was reflected back into the plasma arc. However, this is a relatively minor increase in relative intensity of the weak line peak, and it is generally advantageous to accept such minor increases in order to decrease the relative intensity of the strong lines. Moreover, it will be appreciated that the optical filter also causes a slight decrease in the overall intensity across the entire emitted spectrum. Accordingly, even though the peak intensity 157 of the weak line 156 has increased, the intensity at wavelengths in the immediate vicinity of the weak line has decreased, with the result that the average integrated power over a narrow waveband 158 centered about the weak line 156 has actually decreased, and is therefore actually closer to the desired spectrum.

The waveband 156 is sufficiently different from the waveband 163 that a greater percentage of energy at the waveband 156 passes the partially reflecting optical filter 62, which is designed to selectively filter the various wavebands with different transmission percentages selected according to the particular application.

An additional operating parameter relates to water jacket pressure, namely operating pressure of water in the annular cooling chamber 24. In this embodiment, the cooling device 14 shown in FIG. 1 is pressurizable to provide an adjustable pressure of the second flow of liquid through the cooling chamber 24 to produce a desired pressure load on the inner envelope. It will be appreciated that the gas and cooling water supplied to the arc chamber 18 are at relatively high pressures, typically about seven atmospheres ($7\times10^5$ pa), for example. Assuming that the inner envelope 12 is carrying most of the thermal load due to a higher degree of filtering, to reduce total stress on the envelope 12 it may be preferable to operate the apparatus with water pressures on opposite sides of the envelope 12 being at approximately equal pressures. Thus, to reduce the pressure gradient across the inner envelope 12, water in the cooling chamber 24 may be operated at a pressure that closely approximates to pressure within the arc chamber 18. However, to reduce the pressure gradient across the outer envelope 13, water pressure in the chamber 24 is operated slightly below pressure within the arc chamber. Thus, a water jacket pressure of six atmospheres ($6\times10^5$ pa) results in a relatively large pressure gradient across the outer envelope 13, but because the outer envelope 13 does not carry much thermal load due to filtering, the envelope 13 is not subjected to excessive loading. Alternatively, the fluid pressure within the cooling chamber 24 may be selected to achieve a desired balance between the pressure gradient across the inner envelope 12 and the pressure gradient across the outer envelope 13. For example, if desired, the cooling chamber pressure may be set to 4 atmospheres to produce equal pressure loads of 3 atmospheres across the inner and outer envelopes.

Rates of water flow through the arc chamber 18 and the cooling chamber 24 are adjusted to maintain exit temperatures of the water below boiling point so as to avoid excessive vapour generation problems. Similarly to the operation of the previously mentioned patented devices, cooling water from the chambers 18 and 24 exits the apparatus through the outlet housing 26, is cooled and then pumped back into the inlet housing.

ALTERNATIVES

As previously described, the inlet housing 25 serves as the cooling liquid inlet for the cooling chamber 24. Alternatively, depending on the orientation of the arc lamp 11, the water for the cooling chamber 24 could be fed into the outlet housing 26 and discharged through the inlet housing 25.

The apparatus as described discloses two independent and separate liquid cooling systems for the arc chamber 18 and for the annular cooling chamber 24 which simplifies a retro-fit installation. In some circumstances, to eliminate duplication of re-circulating and cooling equipment, it may be desirable to combine cooling liquid re-circulating systems for both chambers 18 and 24 into one system.

The electrodes 28 and 29 of FIG. 1 carry a direct current arc and are polarized so as to be a cathode and anode respectively. In an alternative, alternating current could be substituted for the direct current, and thus the electrodes 28 and 29 would no longer be a D.C. cathode and anode respectively.

While specific embodiments of the invention have been described and illustrated, such embodiments should be considered illustrative of the invention only and not as limiting the invention as construed in accordance with the accompanying claims.

What is claimed is:

1. A method for producing high intensity electromagnetic radiation, the method comprising:

a) generating a high power plasma arc between first and second electrodes of a high intensity arc lamp having an inner envelope and having a first flow of liquid along an inside surface of said inner envelope, said arc emitting said radiation; and b) producing a second flow of liquid in contact with an outside surface of said inner envelope.

2. The method of claim 1 wherein producing said second flow comprises directing said second flow of liquid through a cooling chamber defined between said outside surface of said inner envelope and an inside surface of an outer envelope surrounding said inner envelope.

3. The method of claim 1 wherein generating said arc further comprises generating a vortex motion within said first flow of liquid to constrain said first flow along said inside surface of said inner envelope.

4. The method of claim 1 wherein generating said high power arc comprises generating said arc at a power of at least 50 kilowatts.

5. The method of claim 1 further comprising adjusting a pressure of said second flow to produce a desired pressure gradient across said inner envelope.

6. The method of claim 2 further comprising:

a) operating the first flow of liquid on the inside surface of the inner envelope at a first pressure; and b) operating the second flow of liquid on the outside surface of the inner envelope at a second pressure selected to achieve a desired balance between a first pressure gradient across the inner envelope and a second pressure gradient across the outer envelope.

7. The method of claim 2 further comprising filtering selected radiation wavelengths from a first radiation spectrum generated by said arc to produce a second radiation spectrum.

8. The method of claim 7 wherein filtering comprises reflecting at least some radiation at said selected wavelengths back into said inner envelope.

9. The method of claim 7 wherein filtering comprises partial reflection and absorption of energy.

10. The method of claim 7 further comprising filtering selected radiation wavelengths from said second radiation spectrum to produce a third radiation spectrum.

11. The method of claim 10 wherein:

a) filtering the first radiation spectrum comprises transmitting the first radiation spectrum from the arc into a first optical filter on the inner envelope; and b) filtering the second radiation spectrum comprises transmitting the second radiation spectrum through a second optical filter on the outer envelope.

12. The method of claim 11 further comprising absorbing more energy on the inner envelope than on the outer envelope so that the inner envelope is exposed to a higher thermal load than the outer envelope.

13. A method for approximating a desired radiation spectrum comprising the method of claim 1 and further comprising redistributing energy within a first radiation spectrum generated by said arc to produce a second radiation spectrum.

14. The method of claim 13 wherein redistributing comprises reflecting a first portion of energy at a first waveband centered about a strong line of said first radiation spectrum back into said arc, such that at least some of said first portion of energy is re-emitted at a second wavelength outside said first waveband.

15. The method of claim 14 wherein redistributing comprises exposing a partially reflecting optical filter to the first radiation spectrum, said filter being operable to reflect said first portion of energy at said first waveband and to allow a second portion of energy at said first waveband and at least some of said energy at said second wavelength to pass therethrough.

16. The method of claim 14 further comprising filtering said second radiation spectrum to produce a third radiation spectrum.

17. The method of claim 14 further comprising operating the first flow of liquid on the inside surface of the inner envelope at a first pressure, and wherein producing said second flow comprises directing said second flow of liquid through a cooling chamber defined between said outside surface of said inner envelope and an inside surface of an outer envelope surrounding said inner envelope, said second flow having a second pressure selected to achieve a desired balance between a first pressure gradient across the inner envelope and a second pressure gradient across the outer envelope.

18. An apparatus for producing high intensity electromagnetic radiation, the apparatus comprising:

a) a high intensity arc lamp having an inner envelope cooled by a first flow of liquid along an inside surface of said inner envelope and having first and second electrodes for generating a high power plasma arc within said inner envelope, said arc emitting said radiation; and b) a cooling device for producing a second flow of liquid in contact with an outside surface of said inner envelope.

19. The apparatus of claim 18 further comprising an outer envelope surrounding said inner envelope to define a cooling chamber in a space between said outside surface of said inner envelope and an inside surface of said outer envelope.

20. The apparatus of claim 19 wherein said cooling device comprises a cooling chamber liquid inlet and a cooling chamber liquid outlet for directing said second flow of liquid to flow through said cooling chamber.

21. The apparatus of claim 19 wherein said cooling device is pressurizable to provide an adjustable pressure of said second flow to produce a desired pressure load on said inner envelope.

22. The apparatus of claim 19 further comprising an inner flow generator for producing said first flow of liquid along said inside surface of said inner envelope.

23. The apparatus of claim 22 wherein said inner envelope comprises an axially elongated cylindrical inner tube and wherein said outer envelope comprises an axially elongated cylindrical outer tube having a radius greater than a radius of said inner tube.

24. The apparatus of claim 23 wherein said inner flow generator comprises a vortex generator for generating a vortex motion within said first flow of liquid to constrain said first flow along said inside surface of said inner envelope.

25. The apparatus of claim 23 wherein said inner flow generator comprises an arc chamber fluid inlet adapted to inject said first flow of liquid into an arc chamber defined within said inner envelope, to generate a vortex motion within said first flow of liquid to cause said liquid to flow along said inside surface of said inner envelope, and to admit a gas into said arc chamber to sustain said arc.

26. The apparatus of claim 25 wherein said inner flow generator further comprises an arc chamber fluid outlet permitting removal of said liquid and gas from said arc chamber.

27. The apparatus of claim 26 further comprising:

a) an inlet housing cooperating with the arc chamber fluid inlet, the housing containing inner and outer seals cooperating with adjacent inlet end portions of the inner and outer envelopes respectively to prevent leakage therefrom; and b) an outlet housing cooperating with the arc chamber fluid outlet, the outlet housing containing inner and outer seals cooperating with adjacent outlet end portions of the inner and outer envelopes respectively to prevent leakage therefrom.

28. The apparatus of claim 27 further comprising a spacer cooperating with adjacent end portions of the inner and outer envelopes to provide the cooling chamber therebetween.

29. The apparatus of claim 28 wherein the spacer has an inner annular face generally complementary to the inner envelope and a seal groove to locate the inner seal which cooperates with the inner envelope to seal thereagainst.

30. The apparatus of claim 28 wherein the spacer has conduits to conduct cooling fluid relative to the cooling chamber.

31. The apparatus of claim 28 wherein:

a) the spacer has an annular body portion which cooperates with at least one of the inlet housing and the outlet housing to locate the body portion with respect to the housing, the spacer also having a plurality of fingers extending axially from the body portion, each finger having respective proximal and distal portions separated by an intermediate shoulder, the proximal portion having a radial depth greater than radial depth of the distal portion by depth of the intermediate shoulder;

b) the outer envelope has an inner surface which is received on the distal portions of the fingers, and an annular envelope rim located generally adjacent the intermediate shoulder; and c) the inner envelope is embraced by the plurality of fingers which are sandwiched between the inner and outer envelopes to space the inner and outer envelopes radially apart so as to define the cooling chamber therebetween.

32. The apparatus of claim 31 wherein the fingers are disposed circumferentially apart around a partially annular intermediate face of the spacer to define a plurality of clearance spaces between the fingers, one space being located between each of the fingers, the clearance spaces serving as conduits to conduct fluid relative to the cooling chamber.

33. The apparatus of claim 28 further comprising a seal retainer which cooperates with the outer envelope, the spacer, at least one outer seal, and at least one of the inlet housing and the outlet housing to seal the outer envelope with respect to the housing.

34. The apparatus of claim 33 wherein the seal retainer is annular and encloses the spacer and an end portion of the outer envelope, the seal retainer having a pair of axially spaced annular end faces, in which at least one particular end face cooperates with a respective outer seal to seal the retainer, the spacer and the outer envelope within the housing.

35. The apparatus of claim 34 wherein the particular end face of the seal retainer is generally truncated conical and cooperates with the respective outer seal to generate a radially inwardly directed force on the seal to augment sealing of the outer envelope.

36. The apparatus of claim 34 wherein:

a) each housing contains two outer seals; and b) each annular end face of the seal retainer is generally truncated conical and cooperates with the respective outer seal to generate a generally radially inwardly directed force on the respective seal so as to augment sealing of the outer envelope and the spacer with respect to the retainer.

37. The apparatus of claim 34 wherein:

a) the spacer has conduits to conduct cooling fluids relative to the cooling chamber; and b) the seal retainer has at least one conduit which communicates with the conduits of the spacer to conduct fluid relative to the cooling chamber.

38. The apparatus of claim 37 wherein said at least one conduit comprises an annular manifold extending circumferentially around an inner surface of said seal retainer.

39. The apparatus of claim 37 wherein said at least one conduit comprises a plurality of holes extending through said seal retainer, said holes being spaced apart along a circumferential line around said seal retainer.

40. The apparatus of claim 27 wherein each housing further comprises:

a) an axially aligned, inwardly facing recess having a rim portion; and b) an annular compression ring to enclose the outer tube and to be received within the recess of the housing, the compression ring having an annular ring seal face cooperating with an outer seal to apply force thereto to augment sealing between the outer tube and the housing.

41. The apparatus of claim 40 wherein the ring seal face of the compression ring is generally truncated conical and cooperates with the outer seal to apply force thereto to generate an inwardly directed force on the outer seal to augment sealing between the outer tube and the housing.

42. The apparatus of claim 33 wherein:

a) each housing further comprises:

i) an axially aligned, inwardly facing recess having a rim portion;

ii) an annular compression ring to enclose the outer tube and to be received within the recess of the housing, the compression ring having an annular ring seal face cooperating with an outer seal to apply force thereto to augment sealing between the outer tube and the housing;

iii) first and second outer seals; and iv) an annular housing seal face extending around the inwardly facing recess of the housing; and b) the seal retainer is received within the recess and encloses the spacer and the end portion of the outer tube, the seal retainer having first and second axially spaced annular end faces, the first outer seal being located between the first end face of the seal retainer and the housing seal face, and the second outer seal being located between the second end face of the seal retainer and the ring seal face of the compression ring so that inward movement of the annular compression ring with respect to the housing compresses the outer seals, and generates inwardly directed forces on the seals to augment sealing of the spacer and the outer tube.

43. The apparatus of claim 42 wherein said seal retainer floats in said recess, such that said inward movement of said annular compression ring compresses each of said outer seals with equal force.

44. The apparatus of claim 18 wherein said first and second electrodes comprise high voltage electrodes for generating said arc at a power of at least 50 kilowatts.

45. The apparatus of claim 19 further comprising an optical filter cooperating with at least one of said inner and outer envelopes to filter selected radiation wavelengths from a first radiation spectrum generated by the arc.

46. The apparatus of claim 19 further comprising an inner optical filter cooperating with the inner envelope to filter from a first radiation spectrum generated by the arc selected wavelengths to generate a second radiation spectrum which radiates into the cooling chamber.

47. The apparatus of claim 46 further comprising an outer optical filter cooperating with the outer envelope to filter from the second radiation spectrum selected wavelengths to generate a third radiation spectrum which radiates from the apparatus.

48. The apparatus of claim 47 in which the inner and outer optical filters are selected so that each filter filters specific wavelengths so as to distribute thermal load arising from the filtering between the inner and outer envelopes.

49. The apparatus of claim 45 wherein the optical filter includes a partially reflecting optical filter cooperating with the inner envelope, the partially reflecting optical filter being adapted to pass a first portion of the first radiation spectrum therethrough, and to reflect a second portion at a first wavelength of the first radiation spectrum back into the plasma arc such that said arc re-emits some energy of said second portion as a second waveband which is sufficiently different from the first waveband to pass through the partially reflecting optical filter.

50. The apparatus of claim 45 wherein said optical filter comprises a partially reflecting optical filter for reflecting at least some radiation at said selected wavelengths back into said inner envelope.

51. An apparatus for approximating a desired radiation spectrum comprising the apparatus of claim 18 and further comprising an energy redistributor for redistributing energy within a first radiation spectrum generated by said arc to produce a second radiation spectrum.

52. The apparatus of claim 51 wherein said energy redistributor comprises a partially reflecting optical filter for reflecting a first portion of energy at a first waveband centered about a strong line of said first radiation spectrum back into said arc, to cause said arc to re-emit at least some of said first portion of energy at a second wavelength outside said first waveband.

53. The apparatus of claim 52 wherein said partially reflecting optical filter is operable to reflect said first portion of energy at said first waveband and to allow a second portion of energy at said first waveband and at least some of said energy at said second wavelength to pass therethrough.

54. The apparatus of claim 52 further comprising a second optical filter for filtering said second radiation spectrum to produce a third radiation spectrum.

55. An apparatus for producing high intensity electromagnetic radiation, the apparatus comprising:

a) means for generating a high power plasma arc between first and second electrodes of a high intensity arc lamp having an inner envelope and having a first flow of liquid along an inside surface of said inner envelope, said arc emitting said radiation; and b) means for producing a second flow of liquid in contact with an outside surface of said inner envelope.

56. An envelope assembly for a high intensity radiation apparatus, the assembly comprising:

a) an inner envelope having an inside surface defining in part an arc chamber;

b) an outer envelope enclosing the inner envelope, the inner and outer envelopes defining in part therebetween a cooling chamber; and c) inlet and outlet spacers, each of the spacers cooperating with an inside surface of the outer envelope and an outside surface of the inner envelope to provide the cooling chamber extending therebetween, the spacers having conduits to conduct cooling liquid relative to the cooling chamber.

57. The assembly of claim 56 wherein each spacer has an inner face locating an inner seal which cooperates with the inner envelope to seal thereagainst.

58. The assembly of claim 56 further comprising an optical filter cooperating with at least one of the inner envelope and the outer envelope to filter selected radiation wavelengths from a first radiation spectrum generated by an arc discharge.

59. The assembly of claim 56 further comprising an inner optical filter cooperating with an outside surface of the inner envelope.

60. The assembly of claim 56 wherein a) each spacer has an annular body portion which cooperates with a housing to locate the body portion with respect to the housing, the spacer also having a plurality of fingers extending axially from the body portion, each finger having respective proximal and distal portions separated by an intermediate shoulder, the proximal portion having a radial depth greater than radial depth of the distal portion by depth of the intermediate shoulder;

b) the outer envelope has an inner surface which is received on the distal portions of the fingers, and an annular envelope rim located generally adjacent the intermediate shoulder; and c) the inner envelope is embraced by the plurality of fingers which are sandwiched between the inner and outer envelopes to space the inner and outer envelopes radially apart so as to define the cooling chamber therebetween.

* * * * *